US007306427B2

(12) United States Patent
Ahlroth et al.

(10) Patent No.: US 7,306,427 B2
(45) Date of Patent: Dec. 11, 2007

(54) SEALING ARRANGEMENT FOR THE ATTACHMENT OF A SIDE PLATE OF A CENTRIFUGAL PUMP AND AN ATTACHMENT SCREW USED THEREWITH

(75) Inventors: Jussi Ahlroth, Jämsä (FI); Jorma Lehtonen, Mänttä (FI)

(73) Assignee: Sulzer Pumpen AG, Winterthur (CH)

( * ) Notice: Subject to any disclaimer, the term of this patent is extended or adjusted under 35 U.S.C. 154(b) by 0 days.

(21) Appl. No.: 11/413,272

(22) Filed: Apr. 28, 2006

(65) Prior Publication Data

US 2006/0263212 A1 Nov. 23, 2006

(30) Foreign Application Priority Data

Apr. 29, 2005 (FI) ..... 20050451

(51) Int. Cl.
*F04D 29/44* (2006.01)

(52) U.S. Cl. ..... 415/196; 415/173.1

(58) Field of Classification Search ..... 415/172.1, 415/173.1, 173.2, 173.3, 206, 196; 411/369, 411/389, 542

See application file for complete search history.

(56) References Cited

U.S. PATENT DOCUMENTS

| | | | | |
|---|---|---|---|---|
| 3,032,259 A | | 5/1962 | Jassniker | |
| 3,130,678 A | * | 4/1964 | Chenault | 415/196 |
| 5,921,748 A | | 7/1999 | Frater | |
| 6,464,454 B1 | * | 10/2002 | Kotkaniemi | 415/121.1 |

* cited by examiner

*Primary Examiner*—Edward K. Look
*Assistant Examiner*—Dwayne J White
(74) *Attorney, Agent, or Firm*—Townsend and Townsend and Crew, LLP

(57) ABSTRACT

The present invention relates to a sealing arrangement for attaching a side plate often used with a pump volute of a centrifugal pump and an attachment screw used therewith. A characterizing feature of the sealing arrangement for attaching the side plate of a centrifugal pump, comprising at least a pump volute (10) and a side plate (130) with attachment screws (132) and flanges (164) of the screws (132) arranged in communication with the volute (10) or the cover of the casing, is that an annular seal (180) is arranged between the screw (132) and the volute or the cover of the casing.

7 Claims, 2 Drawing Sheets

SEALING ARRANGEMENT FOR THE ATTACHMENT OF A SIDE PLATE OF A CENTRIFUGAL PUMP AND AN ATTACHMENT SCREW USED THEREWITH

BACKGROUND OF THE INVENTION

The present invention relates to a sealing arrangement for the attachment of a side plate often used in connection with a pump volute of a centrifugal pump and an attachment screw used therewith.

A centrifugal pump comprises, as known, mainly a so-called volute with a suction opening, a discharge opening, and an impeller rotating inside the volute. Since the efficiency and capacity of the pump are substantial both for the manufacturer, seller and especially for the end user, the clearances between the impeller and the volute must be optimal, in other words in most cases as small as possible. By using modern production methods, it is possible to manufacture optimal clearances in new pumps. However, when pumping even slightly erosive fluids, such as different suspensions, especially the edges of the impeller vanes facing the volute are subjected to wearing, whereby the clearance thereof to the front wall of the volute increases and the efficiency of the pump is reduced. To correct the disadvantage, for example, the front wall of the pump volute facing the impeller vanes is made adjustable. To enable this, a removable side plate is arranged at the front wall of the volute, the position of which side plate may be adjusted in the axial direction of the pump.

The adjustable side plate of the volute of a centrifugal pump is attached to the pump volute with at least three screws enabling the adjustment. The side plate is sealed in accordance with the prior art as illustrated in FIG. 1 by two O-rings, of which one is located at the outer rim of the side plate and the other at the diameter of the inner cylindrical surface of the side plate. The O-rings seal the side plate both at the pressure side of the pump and at the suction side so that the adjustment screws, which function also as attachment screws, are not normally in contact with the liquid to be pumped. If the O-rings leak for some reason, the liquid to be pumped leaks to the back side of the side plate and the adjustment screws get into contact with the liquid. This is not as such detrimental, but a problem arises because the liquid to be pumped is able to leak through the openings arranged for the adjustment or attachment screws in the volute to the outside of the pump. There are, of course, O-rings manufactured of modern materials, which rings could be used in the above-described positions, but as they are large rings, they are almost as expensive as the rest of the pump. Because of the high price, such a construction is not competitive on the market.

SUMMARY OF THE INVENTION

It is an object of the present invention to eliminate at least some of the above-described problems and disadvantages concerning centrifugal pumps of the prior art by introducing a new kind of method of attaching and sealing a side plate, which method substantially differs from the prior art.

In accordance with a preferred embodiment of the present invention, a characteristic feature of the sealing arrangement for the attachment of a side plate of a centrifugal pump comprising a pump volute and a side plate with its attachment screws and screw flanges located in connection with the volute or a cover of the casing is that an annular seal is arranged between the flange of the screw and the volute.

In accordance with another preferred embodiment of the invention, a characteristic feature of an attachment screw of a side plate of the volute or cover of the casing of a centrifugal pump with the screw being threaded at its both ends, having a flange arranged therebetween and means arranged at one end of the screw for tightening the screw, is that a groove for a seal ring has been arranged in the flange in its surface facing the tightening means.

In other words, a large O-ring is located, according to a preferred embodiment of the invention, at the outer rim of the side plate to seal and to separate a leakage flow from the pressure side to the suction side of the pump, and a small O-ring is located between a flange of the attachment screw and the pump volute to seal the gap therebetween and prevent the leakage fluid from flowing out. The large O-ring does not have to be completely leak-proof, but the smaller O-ring must endure both the mechanical and chemical loads, and, if necessary, materials, such as FFKM or like, enduring aggressive chemicals must be used as the seal ring material. Thanks to the small O-ring, which is inexpensive to acquire, the structure of the invention becomes significantly more cost-effective and therefore also more competitive.

Other characteristic features of a sealing arrangement for the attachment of a side plate of a centrifugal pump and an attachment screw used therewith in accordance with the present invention become apparent in the accompanying claims.

The sealing arrangement for the attachment of a side plate of a centrifugal pump in accordance with the invention and an attachment screw used therewith are described more in detail, by way of example, with reference to the accompanying drawings.

DESCRIPTION OF THE PREFERRED EMBODIMENTS

Figure 1:
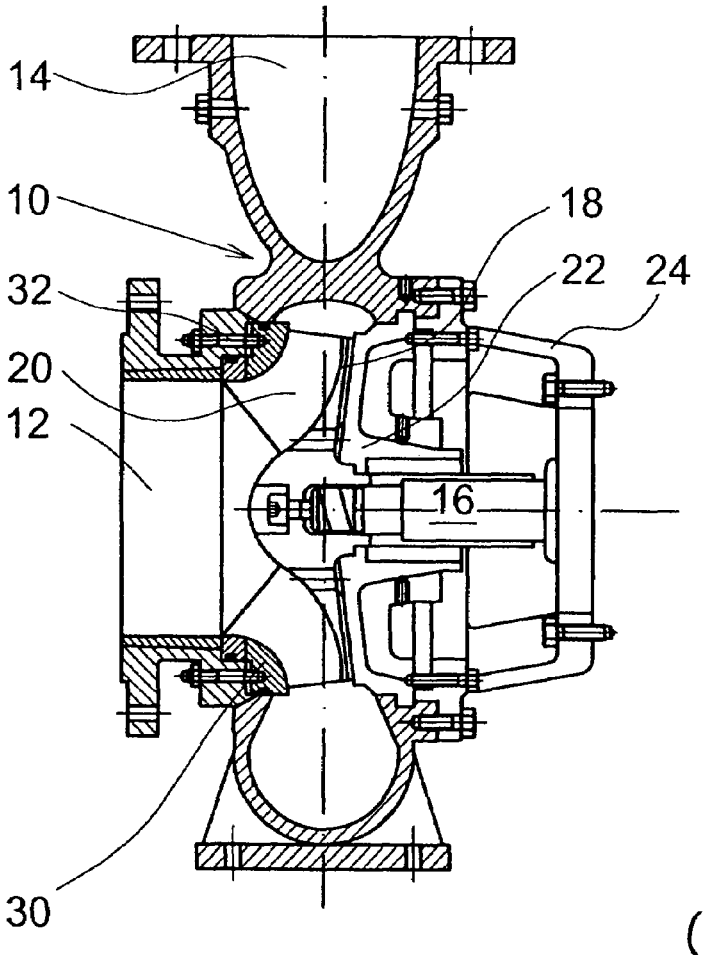
Fig. 1 (PRIOR ART)
FIG. 1 illustrates schematically a partially sectional view of a prior art centrifugal pump.

According to FIG. 1, a centrifugal pump in accordance with the prior art comprises a volute 10 with a suction opening 12 and a pressure opening 14, an impeller 18 with working vanes 20 located on a shaft 16 inside the volute 10, a pump rear wall 22 and a pump casing 24 with bearings. The drawing also illustrates a so-called adjustable side plate 30 of the volute 10, attached to the volute preferably with at least three adjustment screws 32.

Figure 2:
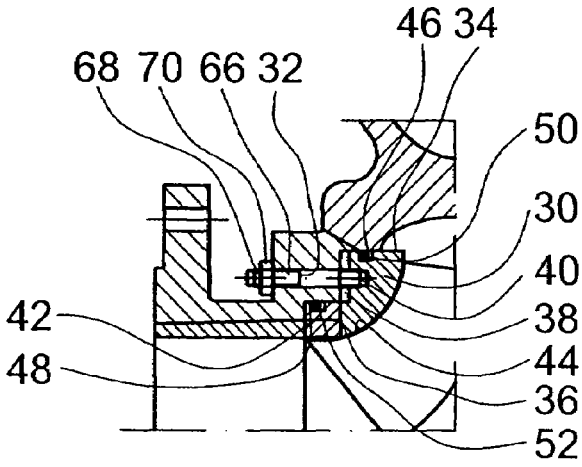
Fig. 2 (PRIOR ART)
FIG. 2 illustrates schematically a pump volute of FIG. 1 and especially the attachment of a so-called adjustable side plate of the volute.

FIG. 2 illustrates the structure and attachment of the side plate 30 in accordance with prior art more in detail. The side plate 30 is an annular member with two radially outwards opening cylindrical surfaces 34 and 36. The surface 34 is located at the outer rim of the side plate 30 and guides the side plate 30 inside a larger cylindrical surface of the volute 10 within a small clearance therefrom. A second cylindrical surface 36 of the side plate 30 with a smaller diameter is located against a corresponding cylindrical surface of the volute 10 within a small clearance therefrom. In the pump illustrated in this drawing, the surfaces 34 and 36 of the side plate 30 are connected by means of a substantially radial surface 38 having threaded holes 40 machined therein for attaching the side plate 30 to the pump volute 10. The inner cylindrical surface 36 of the side plate 30 terminates to an end surface 42 of the side plate 30 at its end opposite to a plane 38, which end surface 42 extends from the cylindrical surface 36, in this structural alternative, substantially radially inwards to the diameter of the suction opening 12 of the volute. Finally, a curved surface 44 following the shape of the outer edges of the working vanes 20 of the impeller connects a radially inner edge of the substantially radial plane 42 to an edge of the outer cylindrical surface 34 of the side plate 30 opposite to the radial plane 38. In the manner illustrated in FIGS. 1 and 2, the curved surface 44 of the side plate 30 extends along substantially the whole length of the outer edge of the working vane 20 leaving an appropriate operating clearance between the working vane and itself.

The side plate 30 is sealed with two O-rings 46 and 48, of which the larger one 46 is located at the outside diameter, or outer rim, of the side plate 30 in a groove 50 in the surface 34 and the smaller one 48 in a groove 52 in the inner cylindrical surface 36 of the side plate. The O-rings 46 and 48 seal the side plate 30 both from the pressure side and from the suction side of the pump so that the attachment/adjustment screws 32 are not normally in contact with the liquid to be pumped. In some cases, the conventional O-rings do not endure the chemicals to be pumped, but begin to leak, whereby on the one hand the attachment screws are subjected to the effects of the chemical and, on the other hand, the pump begins to leak through the attachment openings by means of which the side plate is attached to the pump volute. In this kind of application, it would be possible to use O-rings of better quality, but they are large rings and almost as expensive as the rest of the pump, whereby, because of their high price, this kind of construction is, in practice, not possible.

The adjustable side plate 30 of the volute of the centrifugal pump is attached, by using its threaded holes 40, with at least three attachment or adjustment screws 32 to the pump volute 10. The attachment is carried out in such a way that there are non-threaded openings for the attachment screws in the pump volute 10. Each attachment screw 32 has a flange 64, which is arranged to rest against the volute 10 wall facing the side plate. Each attachment screw 32 has a threaded portion extending substantially from the flange to the tip of the screw that faces the side plate so that the screw 32 can be turned into the threaded hole 40 in the side plate 30. The attachment screw 32 is provided at its opposite end with a threaded part 66 and near the end also with a socket-head, square-head, hex head, screw head or the like 68. The attachment and adjustment of the side plate 10 are carried out as follows. When attaching the side plate 30 to the volute 10, the attachment screws, i.e. adjustment screws 32, are inserted into their openings in the volute with the flanges against the volute wall, the side plate with its O-rings is pushed, guided by the cylindrical surfaces of the volute 10, to its proper position in the volute, and screws 32 are turned into the threaded holes 40 in the side plate 30. The installation of the side plate may be performed also in the opposite order; i.e. the screws 32 are first turned into the threaded holes in the side plate 30 and thereafter the screws are inserted in their openings in the volute and the side plate with the O-rings is pushed to its position in the volute until the screw flanges meet the volute wall. When the volute 10 is then set and attached to its position onto the pump casing 24 to surround the pump impeller, the adjustment/attachment screws 32 are tightened so that they push the side plate 30 towards the impeller 18 of the pump. When the side plate 30 is in contact with the working vanes of the impeller, the clearance is closed. By turning the screws from this position backwards for a certain number of degrees, a desired operating clearance is obtained. Thereafter, nuts 70 driven to the threaded part 66 of the screws 32 are tightened against the surface of the volute in such a way that the side plate 30 cannot move in the axial direction. As can be seen from the above, the openings in the volute that are used for the attachment of the side plate are not sealed in any way, but the liquid leaking between the side plate and the volute is allowed to flow relatively freely out of the openings.

Figure 3:
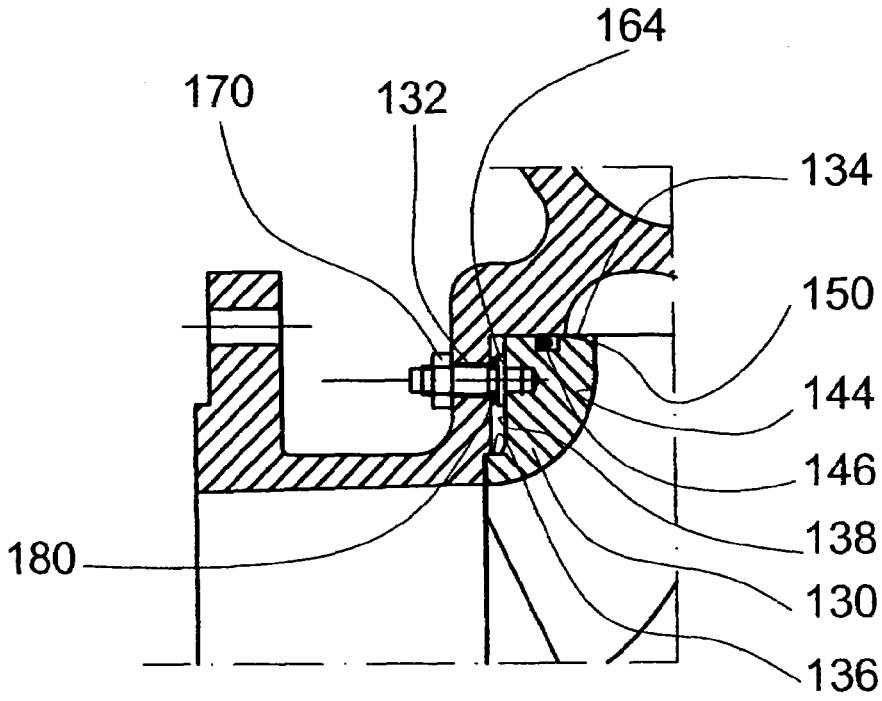
FIG. 3 illustrates schematically the sealing of an adjustable side plate of a pump volute in accordance with a preferred embodiment of the present invention.

FIG. 3 illustrates a sealing arrangement for the attachment of an adjustable side plate 130 of a centrifugal pump in accordance with a preferred embodiment of the present invention. The side plate 130 is in principle of the same shape as the side plate illustrated in the prior art FIGS. 1 and 2. In other words, the side plate 130 has an outer cylindrical surface 134 and an annular groove 150 therein as well as an inner cylindrical surface 136, which, in this embodiment, has a shorter axial length than the prior art side plate, because the use of an O-ring is not at all necessary in connection with the inner surface 136. Similarly, also, surfaces 138 and 142 illustrated radial in this embodiment, as well as a curved surface 144, correspond to the structure of FIGS. 1 and 2. However, it should be understood that the side plate may, if so desired, extend also farther away from the pump axis, i.e. radially outside the outer cylindrical surface 134. In other words, the cylindrical surface 134 need not be the radially outermost part of the side plate.

The actual difference to the solution of the prior art is that the sealing of the pump is taken care of in connection with the adjustment or attachment screw 132 according to a preferred embodiment of the invention by arranging an O-ring seal 180 between the flange 164 of the screw 132 and the pump volute. In other words, also the basic structure and use of the adjustment/attachment screw are similar to the prior art screw. The seal 180 is very small and thus also inexpensive to acquire. Therefore, an O-ring enduring as well as possible the chemicals in the fluid to be pumped can be chosen as a seal for each application without a need to think about the costs. Thus, it is possible to choose a material, such as FFKM, which can endure even very aggressive chemicals. The seal 180 may be placed directly on top of the flange 164 of the screw 132. It is, however, advantageous to arrange a groove in the screw flange 164 for the seal 180, whereby the seal 180 is not alone to receive the whole tightening load coming from locking the screw 132 with a nut 170. The groove may be made either in the outer edge or in the inner circumference of the flange or in the central area of the radial surface of the flange. The most important thing in these structural alternatives is, however, that in all cases the flange of at least part of its radial surface, either inside or outside the O-ring or on both sides thereof, is able to rest on the surface of the volute facing the flange. This ensures that the O-ring is compressed only for a degree optimal for sealing. It is also possible to arrange either optionally or additionally a corresponding annular groove in the face or wall of the pump volute at corresponding positions so that having pressed the seal to a certain extent in the volute groove, the flange of the screw is supported to the counter surface of the pump volute. For this, the diameter of the groove can at most be equal to the outer diameter of the flange of the screw.

In some applications, there is also a possibility to use a seal, which endures the compression so well that there is no need to machine any grooves either in the flange of the screw or in the pump volute.

Figure 4:
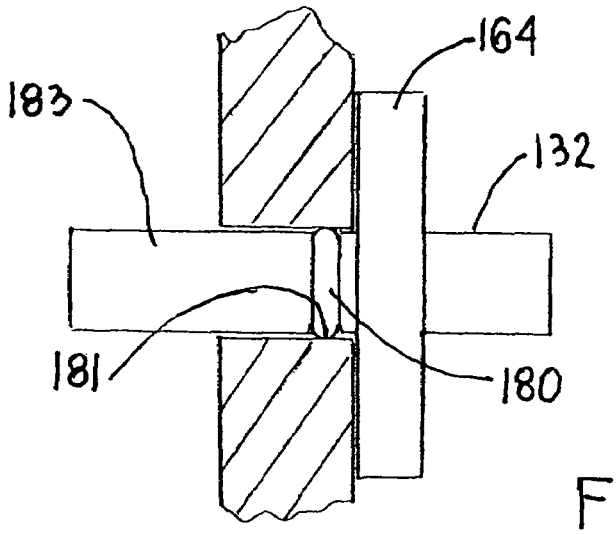
FIG. 4 illustrates placing a seal for each side plate holding screw in a groove on the shaft of the screw.

According to yet another preferred embodiment of the invention, a groove 181 for the seal 180 is arranged either in the cylindrical part 183 of the screw seen from the flange towards the head of the screw (see FIG. 4), which head is provided with the tightening means (not shown in FIG. 4), or in a corresponding part of the opening in the volute or in the cover of the casing. In this case, the seal ring may be located in such a groove before assembling or inserting the screw in the opening.

The rest of the sealing of the side plate 130 is taken care of, for example, by locating a large O-ring 146 either to the groove 150 in the surface 134 at the outer cylindrical surface of the side plate 130 or to a corresponding groove machined in the counter surface of the volute, both to prevent the pressure of the pump escaping to a space between the side plate and the volute and to seal and to prevent the leak flow from the pressure side of the pump to the suction side of the pump. The large O-ring 146 does not have to be completely leak-proof, but a rather minor internal leakage may be allowed. Correspondingly, it is not necessary to seal the side plate from the suction side at all, because it is not at all the purpose in this invention to have the space of the attachment/adjustment screw between the side plate and the volute leak-proof. Similarly, in some cases it is also possible not to seal the outer cylindrical surface of the side plate 130 at all, whereby there is no need to even machine any groove for a seal in the surface.

As can be seen from the description above, a new kind of a sealing arrangement has been developed for the attachment of a side plate of a centrifugal pump and an attachment screw to be used therewith, eliminating disadvantages of the prior art attachment of the side plate. The attachment of a side plate in accordance with the invention enables the attachment of the side plate and the sealing also when pumping chemically demanding liquids so that it is possible to use inexpensive seals of high quality. It must be noted that although the discussion above concerns mainly the adjustable side plate of a centrifugal pump, the above-described attachment and sealing method may also be used in connection with a stationary side plate. And in an exactly corresponding way, where the above description discusses the side plate of the pump in front of the impeller, it is quite possible to use the sealing arrangement in accordance with the invention also with the attachment and sealing of the side plate behind the impeller. Thereby, only the part in question in connection with which a side plate is attached is the rear wall of the pump, which is also more generally called the cover of the casing. While the invention has been herein described by way of examples in connection with what are at present considered to be the preferred embodiments, it is to be understood that the invention is not limited to the disclosed embodiments, but is intended to cover various combinations and/or modifications of its features and other applications within the scope of the invention as defined in the appended claims.

The invention claimed is:

1. A sealing arrangement for attaching a side plate of a centrifugal pump, comprising at least a pump volute, a side plate located in connection with the volute or a cover of a pump casing, said side plate having attachment screws each provided with a screw flange, and a separate annular seal provided for and arranged about each screw for sealing a gap between the screw and the volute or the cover of the casing.

2. Sealing arrangement in accordance with claim 1, wherein the annular seal is arranged between the flange of the screw and the volute or the cover of the casing.

3. Sealing arrangement in accordance with claim 1, wherein the screw is provided with an annular groove for the seal.

4. Sealing arrangement in accordance with claim 1, wherein the flange of the screw is provided with an annular groove for the seal.

5. Sealing arrangement in accordance with claim 1, wherein the pump volute or the cover of the casing is provided with an annular groove for the seal.

6. Sealing arrangement in accordance with claim 4, wherein said annular groove has a diameter which at most equals the outer diameter of the screw flange.

7. Sealing arrangement in accordance with claim 1, wherein the side plate has an outer cylindrical surface provided with a seal groove for a seal.

* * * * *